United States Patent [19]

Taguchi et al.

[11] Patent Number: 4,879,536

[45] Date of Patent: Nov. 7, 1989

[54] ELECTROMAGNETIC RELAY

[75] Inventors: Jisei Taguchi; Yutaka Miura; Kenji Iwanaga, all of Atsugi; Manabu Tada, Hiratsuka, all of Japan

[73] Assignee: Anritsu Corporation, Tokyo, Japan

[21] Appl. No.: 250,338

[22] Filed: Sep. 28, 1988

[30] Foreign Application Priority Data

Sep. 30, 1987 [JP] Japan ..... 62-246184
Sep. 30, 1987 [JP] Japan ..... 62-149379[U]

[51] Int. Cl.[4] ..... H01H 51/08
[52] U.S. Cl. ..... 335/128; 335/203
[58] Field of Search ..... 335/128, 129, 135, 78, 335/79, 80, 81, 82, 83, 84, 85, 86, 203, 281, 282, 279

[56] References Cited

U.S. PATENT DOCUMENTS 4,159,455 6/1979 Bosch et al. ..... 335/81
4,359,703 11/1982 Schedele ..... 335/128
4,472,699 9/1984 Fujii et al. ..... 335/85

*Primary Examiner*—H. Broome

*Attorney, Agent, or Firm*—Frishauf, Holtz, Goodman & Woodward

[57] ABSTRACT

An electromagnetic relay includes a cylindrical bobbin around which a coil is wound, and a step is formed at a middle portion of the cylindrical bobbin. A large-diameter portion is formed at one side of the step, and a smaller-diameter portion is formed at the other side of the step. The outer and inner diameters of the smaller-diameter portion are smaller than those of the large-diameter portion. An armature and a leg of a yoke are inserted in the large-diameter portion, and the armature is inserted in the smaller-diameter portion. The inner diameter of the large-diameter portion corresponds to a total sum of a thickness of the armature, a thickness of the yoke, and a moving stroke of the armature, and that of the smaller-diameter portion corresponds to a total sum of the thickness and the moving stroke of the armature. The coil is wound around the outer surface of the bobbin. A larger number of turns of the coil can be wound around the bobbin than that wound around a bobbin having the same diameter throughout the axial direction by an amount corresponding to a portion (34) of the smaller-diameter portion.

6 Claims, 5 Drawing Sheets

ELECTROMAGNETIC RELAY

BACKGROUND OF THE INVENTION

1. Field of the Invention

The present invention relates to an improved compact electromagnetic relay and, more particularly, to an electromagnetic relay which has a coil bobbin capable of increasing the number of turns of a coil without increasing an outer diameter of the coil and can be made compact.

2. Description of the Related Art

Recently, various electric and electronic parts are made compact, and a demand has arisen for a more compact electromagnetic relay accordingly.

However, a conventional compact electromagnetic relay has a structure similar to that of a comparatively large electromagnetic relay. Therefore, compactness of the conventional electromagnetic relay is limited, and its structure is complex to be manufactured.

FIG. 1 shows a structure of a main part of a conventional compact electromagnetic relay. In FIG. 1, reference numeral 1 denotes a coil bobbin. Guide hole 2 and through hole 3 are formed in bobbin 1, and coil 4 is wound around the outer surface of bobbin 1. One leg of each of a pair of U-shaped yokes 5 and 6 is inserted in guide hole 2, and armature 10 is inserted in through hole 3. One end portion of armature 10 is mounted on yoke 5 through hinge spring 9 which also serves as a hinge. When a current is flowed through coil 4, armature 10 is attracted to yoke 6 against a biasing force of spring 9. Reference numeral 13 denotes a contact block. Break contacts 19, 20 movable contacts 16 and 17, make contacts (not shown), and the like are integrally mounted on block 13. Drive card 22 is mounted on distal end portion 10a of armature 10. When armature 10 moves, card 22 presses movable contacts 16 and 17. Then, movable contacts 16 and 17 moved away from the break contacts 19, 20 and are brought into contact with make contacts 19.

The above structure of the conventional relay has the following various drawbacks in making the relay compact. First, compactness of bobbin 1 and coil 4 is limited. That is, the diameters of guide hole 2 and through hole 3 formed at the center of bobbin 1 must correspond to a total sum of the thicknesses of the legs of yokes 5 and 6 and armature 10 and a moving stroke of armature 10 and cannot be smaller than that. In addition, a magnet wire must be wound around coil 4 in a necessary number of turns. For these reasons, compactness of bobbin 1 and coil 4 is limited.

Furthermore, when the above electromagnetic relay is made compact, the moving stroke of the armature is reduced, and the contacts are also made compact. Therefore, the armature must be accurately moved. For this purpose, when the hinge spring is to be welded to the armature and the yoke, a positional relationship between these parts must be accurately regulated. However, it is difficult to accurately position and weld the above parts especially when, e.g., the hinge spring is small. In order to eliminate this drawback, one end portion of the armature is pivotally fitted in an end portion of the yoke, one end portion of the hinge spring is welded to the yoke or the like, and the other end portion of the hinge spring is mechanically fitted in the end portion of the armature. In this structure, the armature is tensioned to the yoke by a biasing force of the hinge spring so that the two parts are not removed from each other. However, in this structure, a play can be easily generated when the armature moves, and precision obtained upon movement is limited.

When such an electromagnetic relay is made compact, intervals between a plurality of movable contact springs are reduced accordingly, and therefore insulation breakdown easily occurs between the contacts. As a result, compactness of the electromagnetic relay is limited in this point of view.

The present invention has been made in consideration of the above situation and has as its object to provide an electromagnetic relay which is made compact, simple in structure, and can be easily manufactured.

SUMMARY OF THE INVENTION

In order to achieve the above first object, the present invention has a step at a middle portion of a coil winding portion of a cylindrical coil bobbin. A portion at one side of the step is a large-diameter, and a portion at the other side thereof is a small-diameter. A leg of a yoke is inserted to the large-diameter portion, and an armature extends along the entire length of a through hole of the bobbin. Therefore, the diameter of the small-diameter portion corresponds to a total sum of only the thickness, moving stroke of the armature. In the conventional electromagnetic relay, the diameter of the through hole of the bobbin corresponds to a total sum of the thickness of the yoke, the thickness of the armature, and the moving stroke of the armature throughout its entire length, i.e., the diameter of the large-diameter portion. Therefore, the diameter of the above small-diameter portion can be reduced by a value corresponding to the thickness of the yoke. Therefore, a coil can be further wound around the small-diameter portion by an amount corresponding to the thickness of the yoke, and the diameter of the coil can be reduced accordingly. As a result, the electromagnetic relay itself can be made compact.

According to an embodiment of the present invention, first and second spring portions are formed in a hinge spring for supporting an armature. An end portion of the first spring portion is mounted on the armature, and the second spring portion is elastically fitted in a bobbin and an end portion of a yoke, thereby mounting the hinge spring on the bobbin and the yoke. Therefore, the armature can be correctly supported, and assembly can be easily performed. In addition, according to the embodiment of the present invention, a recess portion or a projection is formed on springs abutting surface of a drive card for urging movable contact springs at a position corresponding to a portion between the movable contact springs. Therefore, a surface length of the contacting surface of the drive card at the position corresponding to the portion between the movable contacts is increased, thereby increasing an insulation withstand voltage therebetween. As a result, an interval between the movable contacts can be reduced, and therefore the electromagnetic relay can be made compact.

The above and other features of the present invention will be apparent from a description of an embodiment taken in conjunction with the following drawings.

DETAILED DESCRIPTION OF THE PREFERRED EMBODIMENTS

Figure 1:
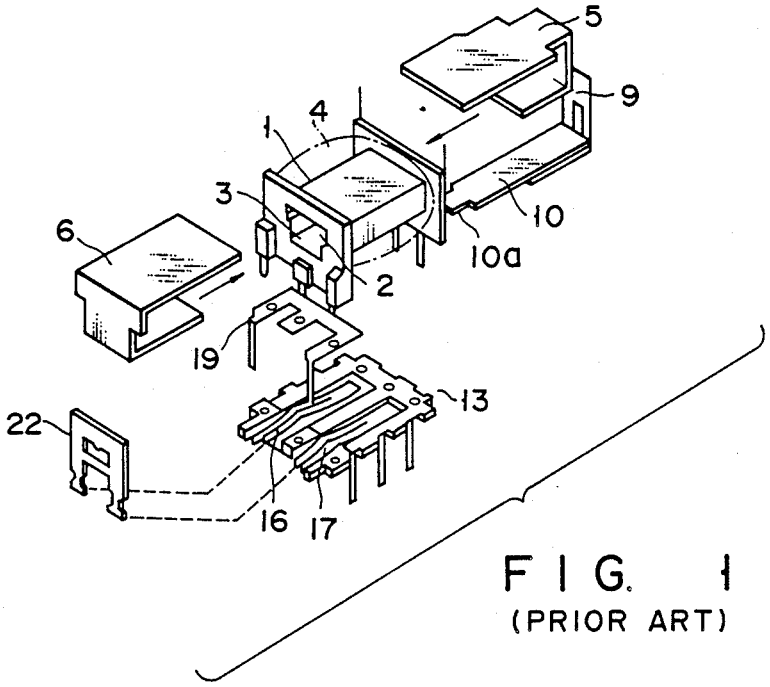
FIG. 1 (PRIOR ART)
FIG. 1 is an exploded perspective view of a main part of a conventional electromagnetic relay.
Figure 2:
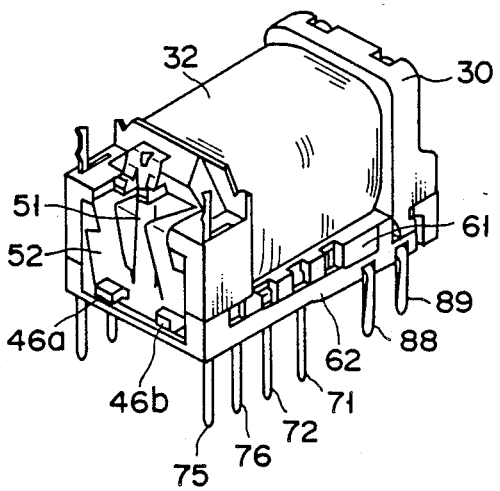
FIG. 2 is a perspective view of a main part of an electromagnetic relay according to an embodiment of the present invention.
Figure 3:
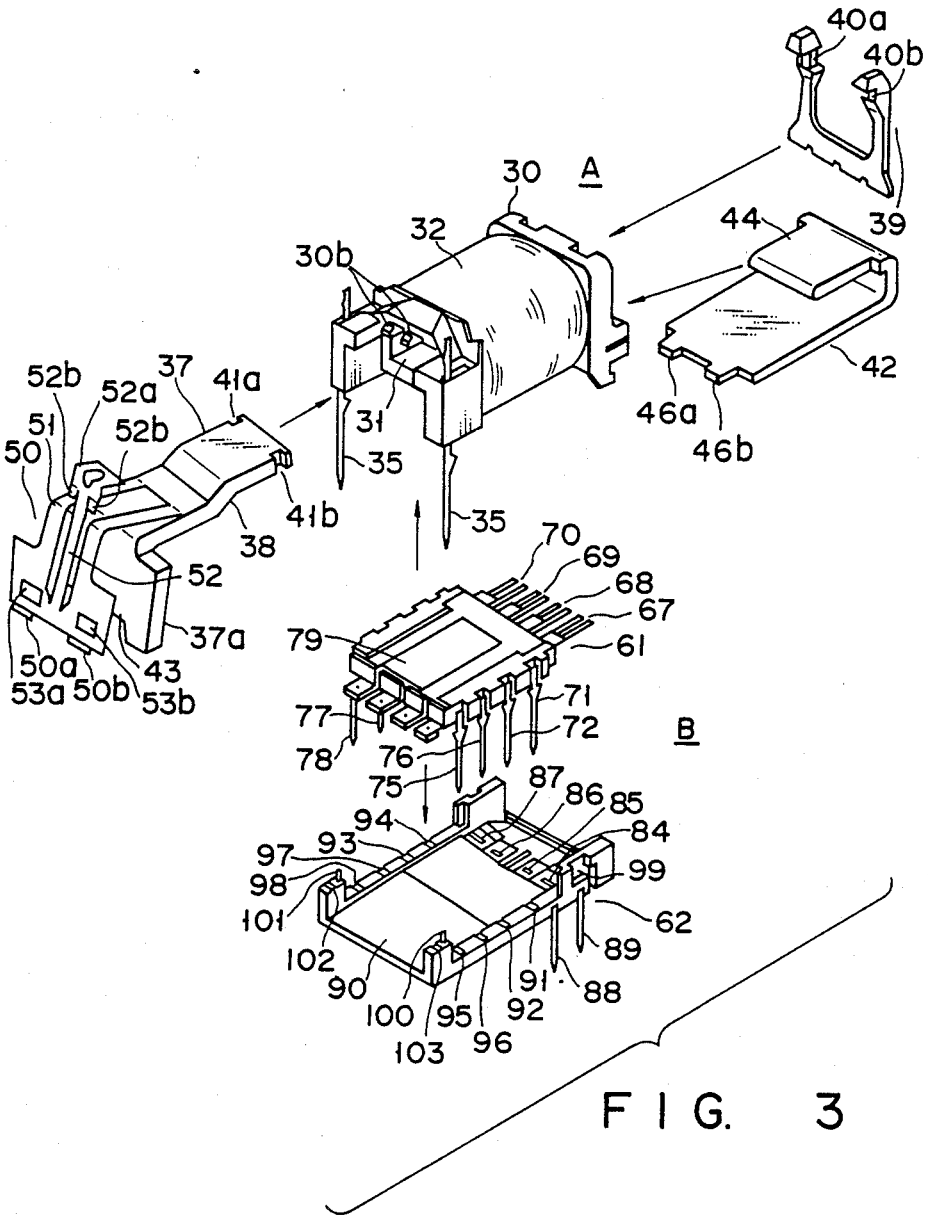
FIG. 3 is an exploded perspective view of a main part of the electromagnetic relay shown in FIG. 2.

FIGS. 2 and 3 show a main part of a compact electromagnetic relay according to an embodiment of the present invention. This electromagnetic relay comprises coil/armature assembly A and contact block assembly B.

Assembly A includes coil bobbin 30, and coil 32 is wound around bobbin 30. Leg 44 of substantially U-shaped yoke 42 is inserted in bobbin 30, and armature 37 is also inserted therein. A proximal end portion of armature 37 is supported by hinge spring 50 comprising a leaf spring. Drive card 39 consisting of an electrically insulating material is mounted on a distal end portion of armature 37.

Assembly B comprises first contact block 61 and second contact block 62. Block 61 includes break contacts 63 to 66 and movable contact springs 67 to 70, and block 62 includes make contacts 84 to 87. Blocks 61 and 62 are stacked and coupled with each other, thereby constituting assembly B.

When coil 32 is energized, armature 37 is attracted to yoke 42, and card 39 mounted on the distal end portion of armature 37 abuts against and urges movable contact springs 67 to 70. As a result, movable contact springs 67 to 70 move away from break contacts 63 to 66 and are brought into contact with make contacts 84 to 87.

Figure 4:
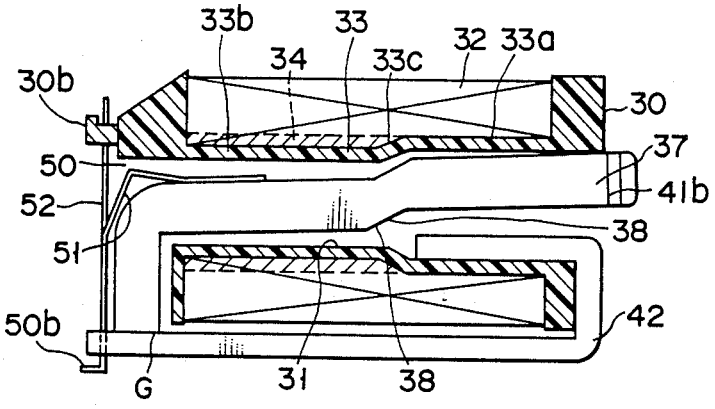
FIG. 4 is a longitudinal sectional view of a coil bobbin of the electromagnetic relay shown in FIG. 2.

Assembly A will be described in detail below. As shown in FIG. 4, cylindrical coil winding portion 33 is formed in bobbin 30, and through hole 31 is formed through portion 33 along its axial direction. Coil 32 is wound around the outer surface of coil winding portion 33. Step **33*c* is formed on a substantially middle portion of coil winding portion 33. Large-diameter portion 33*a* is formed at one side of step 33*c*, i.e., at the right side in FIG. 4, and small-diameter portion 33*b* is formed at the other side, i.e., the left side in FIG. 4. The wall thickness of coil winding portion 33 is formed substantially uniform throughout its entire length. Therefore, the inner and outer diameters are large at large-diameter portion 33*a*, and those at small-diameter portion 33*b* are small. Therefore, the diameter of through hole 31 is large at large-diameter portion 33*a* and is small at small-diameter portion 33*b*. The inner diameter of large-diameter portion 33*a* is set to be a total sum of the thicknesses of yoke 42 and armature 37 and the moving stroke of armature 37. The inner diameter of small-diameter portion 33*b* is set to be a total sum of the thickness and moving stroke of armature 37**.

Coil 32 is wound around the outer surface of coil winding portion 33 of bobbin 30. Therefore, a larger number of turns of coil 32 can be wound than the conventional one by an amount corresponding to a portion represented by reference numeral 34 in FIG. 4. As a result, when a predetermined number of turns of coil 32 is wound, the outer diameter of coil 32 can be reduced smaller than that of the conventional one. In order to wind coil 32, the coil is wound around portion 34 of the outer surface of small-diameter portion **33*b* and then wound around the entire length of bobbin 30. Bent portion 38 bent in correspondence with step 33*c* is formed at a middle portion of armature 37 so that armature 37 is inserted through the center of small-diameter portion 33*b***.

The supporting structure of armature 37 is arranged as follows. A proximal end portion of armature 37 is bent to be an L shape to form leg **37*a*, and rectangular fitting notch portion 43 is formed at a lower edge portion of leg 37*a*. A pair of fitting projections 46*a* and 46*b* are formed at a proximal end portion of yoke 42 and pivotally fitted in notch portion 43. Hinge spring 50 comprises a leaf spring member including fork-like first spring portion 51 extending from the proximal end portion and having a bent middle portion and belt-like second spring portion 52 extending from the proximal end portion. A pair of locking holes 53*a* and 53*b* are formed at the proximal end portion of spring 50 in correspondence with projections 46*a* and 46*b* of the yoke. A pair of stopper projections 50*a* and 50*b* project from an edge of the proximal end portion of spring 50 and are bent in the axial direction of the coil. Wide and bent engaging portion 52*a* is formed at the distal end portion of second spring portion 52. A pair of engaging pieces 52*b* are formed at shoulders of engaging portion 52*a* and are obliquely bent. The distal end portion of first spring portion 51 of spring 50 is mounted on the upper surface of armature 37** by welding or the like.

Figure 5:
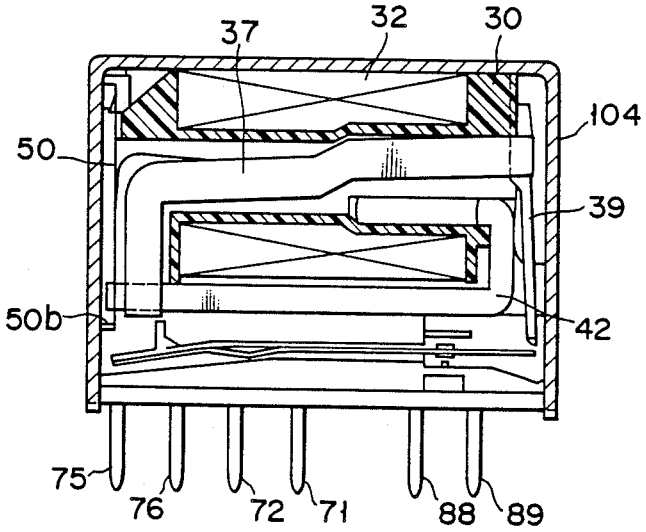
FIG. 5 is a longitudinal sectional view in which a cover is mounted on the electromagnetic relay shown in FIG. 2.
Figure 6:
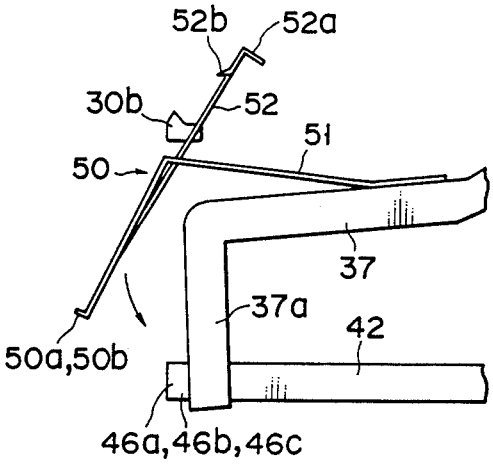
FIG. 6 is a side view of a hinge spring before assembly.
Figure 7:
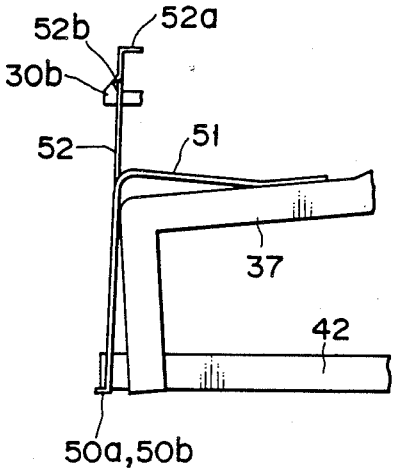
FIG. 7 is a side view of the hinge spring after assembly.

As shown in FIG. 6, locking grooves **46*c* are formed in the lower surfaces of projections 46*a* and 46*b* of the yoke. A pair of engaging projections 30*b* are formed on an upper portion of the proximal end portion of bobbin 30. The hinge spring is mounted as shown in FIGS. 6 and 7. First, as shown in FIG. 6, fitting project and 46*b* of yoke 42 are fitted in fitting notch portion 43 of armature 37. At the same time, the distal end portion of second spring portion 52 of the hinge spring is inserted between engaging projections 30*b*. The lower edge portion of hinge spring 50 is moved downward in a direction indicated by an arrow (FIG. 6) so that fitting projections 46*a* and 46*b* of the yoke are fitted in locking holes 53*a* and 53*b* and lower edges of holes 53*a* and 53*b* are fitted in locking grooves 46*c*. In this case, engaging pieces 52*b* at the distal end portion of second spring portion 52 engage with the upper surfaces of engaging projections 30*b* and elastically deform. Therefore, the lower edges of holes 53*a* and 53*b* are held in grooves 46*c* by an elastic force of the engaging pieces, and spring 50 is fixed to bobbin 30 and yoke 42. The lower edge of leg 37*a* of armature 37 is urged against the proximal end portion of yoke 42 by an elastic force of first spring portion 51 to keep the above state. Portion 51 also serves as a spring for returning armature 37. Note that when cover 104 of the electromagnetic relay is mounted as shown in FIG. 5, the distal end portions of stopper projections 50*a* and 50*b* of spring 50 are abutted against the inner surface of cover 104** and the lower edge portion of the hinge spring reliably prevents removal of projections 46*a* and 46*b*.

A pair of mounting notch portions 41*a* and 41*b* are formed at the distal end portion of armature 37. A pair of mounting legs are formed on drive card 39, and mounting fitting portions 40*a* and 40*b* are formed at the distal end portions of the legs and fitted in mounting notch portions 41*a* and 41*b*, respectively, so that card 39 is mounted at the distal end portion of armature 37. When armature 37 operates, the lower edge of card 39 abuts against and drives movable contact springs 67 to 70.

Figure 8:
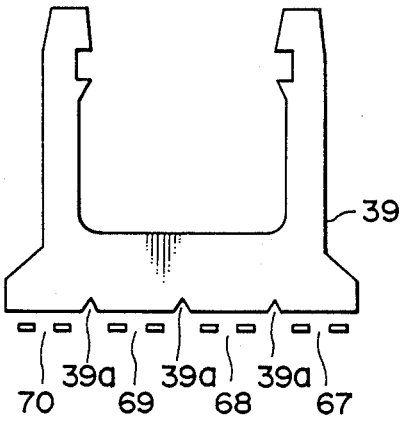
FIG. 8 is a front view of a drive card.

As shown in FIG. 8, insulating grooves 39*a* are formed in the lower edge of card 39 in correspondence with positions between contact springs 67 to 70. An insulation withstand voltage between contact springs 67 to 70 is increased by grooves 39*a*. That is, insulation breakdown occurs when card 39 is brought into contact with contact springs 67 to 70 because a current flows along the surface of the lower edge of the drive card between the movable contact springs. Therefore, when the above insulating grooves are formed in correspondence to the positions between the movable contact springs, the length of the drive card is increased between the movable contact springs, thereby increasing the insulation withstand voltage. Table 1 shows actual measurement values of the insulation withstand voltage and the insulation resistance obtained when the drive card is formed of a PES (polyether sulfone) resin, an interval between the movable contact springs is 0.8 mm, and a width and a depth of the insulating grooves are both 0.3 mm. For comparison, similar data of a drive card not having an insulating groove are shown in Table 2. As is apparent from the Tables, when the insulating grooves are formed, the insulation withstand voltage is increased, and the electromagnetic relay can be advantageously made compact. Note that instead of the insulating grooves, insulating projections may be formed on the lower edge of the drive card.

TABLE 1

| Withstand Voltage Improving Ditch Present | | |
|---|---|---|
| External Terminal No. | Insulation Withstand Voltage (kV) | Insulation Resistance (Ω) |
| 30–31 | >2.75 | $1.8 \times 10^{11}$ |
| 35–34 | >3.0 | $1.2 \times 10^{11}$ |
| 37–36 | >3.0 | $1.2 \times 10^{11}$ |
| 32–33 | >3.0 | $1.8 \times 10^{11}$ |
| 35–36 | >3.25 | $5 \times 10^{11}$ |
| . | . | . |
| . | . | . |
| . | . | . |
| Average | >.29 | $2.33 \times 10^{11}$ |

TABLE 2

| Withstand Voltage Improving Ditch Present | | |
|---|---|---|
| External Terminal No. | Insulation Withstand Voltage (kV) | Insulation Resistance (Ω) |
| 30–31 | >2.0 | $1.2 \times 10^{11}$ |
| 35–34 | >2.5 | $1.2 \times 10^{11}$ |
| 37–36 | >2.5 | $1.6 \times 10^{11}$ |
| 32–33 | >2.0 | $1.9 \times 10^{11}$ |
| 35–36 | >2.25 | $1.5 \times 10^{11}$ |
| . | . | . |
| . | . | . |
| . | . | . |
| Average | >2.28 | $1.68 \times 10^{11}$ |

Figure 9:
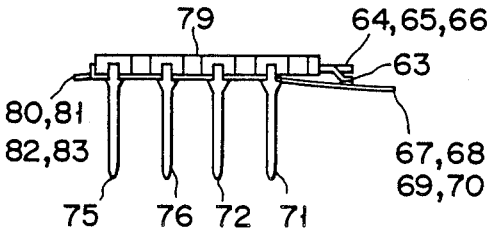
FIG. 9 is a side view of a contact block assembly.
Figure 10:
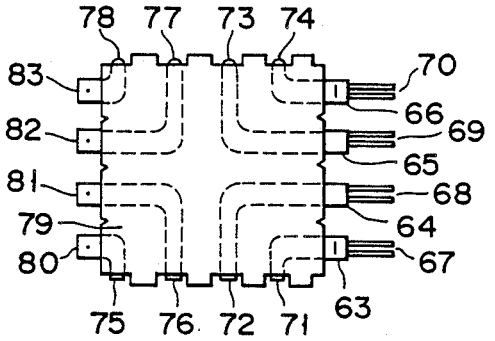
FIG. 10 is a plan view of the contact block assembly.

Assembly B is arranged as follows. That is, as described above, assembly B comprises first contact block 61 and second contact block 62. As shown in FIGS. 9 and 10, in block 61, break contacts 63 to 66, movable contact springs 67 to 70, and terminals 71 to 78 and 80 to 83 connected to these contacts are integrally embedded in base block 79 formed of a synthetic resin. Similarly, in block 62, make contacts 84 to 87 and four terminals (only two terminals 88 and 89 of which are shown in FIG. 3) connected to the contacts are integrally embedded in base block 90 formed of a synthetic resin. First and second contact blocks 61 and 62 are stacked to form the contact block assembly. A pair of projections 100 and 101 project from base block 90 of the second contact block and are fitted in recess portions (not shown) formed in base block 79 of the first contact block, thereby positioning the first and second contact blocks. Terminal insertion holes 91 and 98 are formed in base block 90 of the second contact block. The terminals of first contact block 61 are inserted in holes 91 to 98, thereby positioning and coupling the contact blocks. Terminals 35 for supplying power to coil 32 are formed on bobbin 30 and inserted in terminal insertion holes 102 and 103 formed in base block 90 of the second contact block. The contact block assembly having the above arrangement can be made compact with high precision. Therefore, the electromagnetic relay can be made compact more easily.

The present invention is not limited to the above embodiment. It is obvious to those skilled in the art that the present invention can be variously modified without departing from the spirit and scope of the present invention. Therefore, the present invention is defined by the following claims.

What is claimed is:

1. An electromagnetic relay comprising:

a cylindrical bobbin having a through hole;

a coil wound around an outer surface portion of said bobbin;

a yoke and an armature inserted in said through hole;

a hinge spring supporting a proximal end portion of said armature;

a drive card mounted on a distal end portion of said armature;

movable contact springs driven when said drive card abuts against said movable contact springs;

break and make contacts brought into contact with and moved away from said movable contact springs;

a step formed at a middle portion of the outer surface of said cylindrical bobbin, said bobbin having a large-diameter outer surface portion at one side of said step, and a smaller-diameter outer surface portion at the other side of said step;

2. A relay according to claim 1, wherein:

said large-diameter portion of said bobbin has an inner diameter having a size corresponding to a total sum of a thickness of said leg of said yoke, a thickness of said armature, and a moving stroke of said armature; and said smaller-diameter portion of said bobbin has an inner diameter having a size corresponding to a total sum of the thickness and moving stroke of said armature.

3. A relay according to claim 1, wherein said hinge spring comprises a leaf spring member including a first spring portion and a second spring portion, a distal end portion of said first spring portion being mounted on said armature, and said second spring portion having two end portions, both end portions being mounted on said bobbin and said yoke.

4. A relay according to claim 1, wherein recessed groove-like insulating grooves are formed in an edge of said drive card which abuts against said movable contact springs at positions corresponding to portions between said movable contact springs.

5. A relay according to claim 1, wherein said movable contact springs, said break contacts, and said make contacts are integrally embedded in base blocks formed of an electrically insulating material.

6. A relay according to claim 5, wherein said base block includes insulating projections located between the contacts.

* * * * *